US010157507B2

(12) United States Patent
Kumar et al.

(10) Patent No.: US 10,157,507 B2
(45) Date of Patent: Dec. 18, 2018

(54) VEHICLE MAINTENANCE USING IDENTIFICATION TAGS AND ONBOARD DATA PROCESSING SYSTEM

(71) Applicant: The Boeing Company, Chicago, IL (US)

(72) Inventors: Anil Kumar, Sammamish, WA (US); Kevin Yong Ung, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/223,496

(22) Filed: Mar. 24, 2014

(65) Prior Publication Data

US 2015/0269787 A1 Sep. 24, 2015

(51) Int. Cl.
*G07C 5/00* (2006.01)
*G07C 5/08* (2006.01)

(52) U.S. Cl.
CPC ..... *G07C 5/00* (2013.01); *G07C 5/006* (2013.01); *G07C 5/0825* (2013.01); *G07C 2205/02* (2013.01)

(58) Field of Classification Search
None
See application file for complete search history.

(56) References Cited

U.S. PATENT DOCUMENTS 7,064,668 B2 6/2006 Porad
7,068,170 B2 6/2006 Green
7,545,274 B2 * 6/2009 Coop ..... G06Q 10/06 340/524
7,551,086 B2 * 6/2009 Coop ..... G06Q 50/30 340/457.4
7,589,636 B2 9/2009 Ayyagari et al.
7,598,868 B2 10/2009 Lee et al.
7,621,193 B2 11/2009 Fay et al.
8,130,081 B2 3/2012 Ung et al.
8,231,062 B1 7/2012 Ayyagari et al.
8,237,548 B2 8/2012 Fay et al.
8,321,083 B2 * 11/2012 Beebe ..... G06F 11/0739 701/120
8,384,521 B2 2/2013 Matsen et al.
8,823,554 B2 * 9/2014 Yourkowski ..... G06Q 10/00 235/385

(Continued)

OTHER PUBLICATIONS

Coop et al., "Maintaining the Airworthiness Configuration of Aircraft," U.S. Appl. No. 13/664,121, filed Oct. 30, 2012, 44 pages.

(Continued)

*Primary Examiner* — Redhwan K Mawari
*Assistant Examiner* — Edward Torchinsky
(74) *Attorney, Agent, or Firm* — Yee & Associates, P.C.

(57) ABSTRACT

A method and apparatus for maintaining a vehicle. Identification information for a part on the vehicle is read from an automated identification technology tag, wherein the automated identification technology tag is on the vehicle and associated with the part. Part information for the part is retrieved from an onboard data processing system on the vehicle using the identification information for the part. The part information retrieved from the onboard data processing system may be displayed to a user. The part information stored onboard the vehicle may be synchronized with an off-board system.

19 Claims, 7 Drawing Sheets

(56) References Cited

U.S. PATENT DOCUMENTS

| | | | | |
|---|---|---|---|---|
| 8,991,692 | B2 * | 3/2015 | Kumar | G06F 17/30011 235/375 |
| 2004/0024501 | A1 * | 2/2004 | Muehl | G06Q 10/06 701/29.4 |
| 2010/0085165 | A1 | 4/2010 | Villa et al. | |
| 2011/0169613 | A1 | 7/2011 | Chen et al. | |
| 2012/0044092 | A1 | 2/2012 | Shore et al. | |
| 2012/0118946 | A1 | 5/2012 | Koreis et al. | |
| 2012/0146815 | A1 | 6/2012 | Yourkowski et al. | |
| 2014/0210598 | A1 * | 7/2014 | Mitchell | G06K 19/0701 340/10.5 |

OTHER PUBLICATIONS

Coop et al., "Aircraft Rework Management," U.S. Appl. No. 13/644,827, filed Oct. 4, 2012, 42 pages.

Knox et al., "Aircraft Interior Component Maintenance," U.S. Appl. No. 13/782,475, filed Mar. 1, 2013, 47 pages.

Kumar et al., "Managing Component Information during Component Lifecycle," U.S. Appl. No. 13/914,294, Jun. 10, 2013, 37 pages.

Shore et al., "Aircraft Equipment Management System," U.S. Appl. No. 13/281,896, filed Oct. 26, 2011, 79 pages.

* cited by examiner

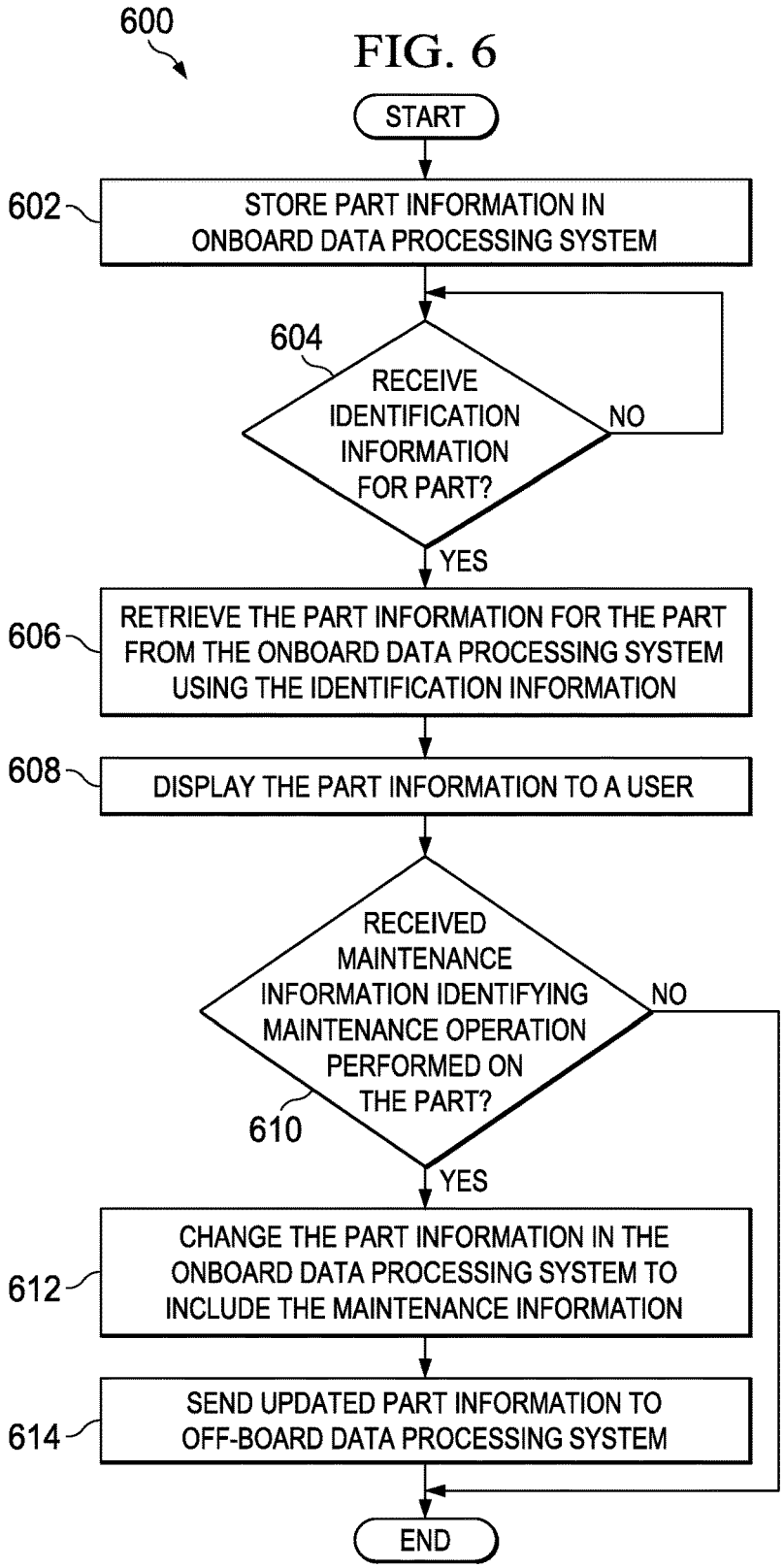
600
FIG. 6
START
602
STORE PART INFORMATION IN ONBOARD DATA PROCESSING SYSTEM
604
RECEIVE IDENTIFICATION INFORMATION FOR PART?
NO
YES
606
RETRIEVE THE PART INFORMATION FOR THE PART FROM THE ONBOARD DATA PROCESSING SYSTEM USING THE IDENTIFICATION INFORMATION
608
DISPLAY THE PART INFORMATION TO A USER
RECEIVED MAINTENANCE INFORMATION IDENTIFYING MAINTENANCE OPERATION PERFORMED ON THE PART?
NO
610
YES
612
CHANGE THE PART INFORMATION IN THE ONBOARD DATA PROCESSING SYSTEM TO INCLUDE THE MAINTENANCE INFORMATION
614
SEND UPDATED PART INFORMATION TO OFF-BOARD DATA PROCESSING SYSTEM
END

VEHICLE MAINTENANCE USING IDENTIFICATION TAGS AND ONBOARD DATA PROCESSING SYSTEM

BACKGROUND INFORMATION

1. Field

The present disclosure relates generally to the maintenance of aircraft and other vehicles and managing the configuration of parts of an aircraft. More particularly, the present disclosure relates to a system and method of using automated identification technology tags and a data processing system onboard an aircraft or other vehicle to manage the maintenance of parts of the aircraft or other vehicle.

2. Background

A vehicle may comprise many component parts. For example, a commercial passenger aircraft may comprise thousands of individually identified parts. The many parts of an aircraft comprise the configuration of the aircraft.

An operator of an aircraft, such as an airline or other operator of the aircraft, may desire to know the current configuration of the aircraft. For example, government regulations may require that the current configuration of a commercial passenger aircraft is known by the airline operating the aircraft. An airline or other operator of an aircraft may maintain configuration information that identifies the current configuration of the aircraft. For example, the configuration information may include parts information that identifies the many parts that currently comprise the aircraft. It is desirable that the configuration information is updated accurately and in a timely manner in response to changes in the parts comprising the aircraft, so that the configuration information accurately identifies the current configuration of the aircraft.

Aircraft may be maintained on a regular basis to ensure safe and efficient operation. Aircraft maintenance may include performing various maintenance operations on the various parts of the aircraft. Inspection of parts, reworking of parts, and replacement of parts are examples of maintenance operations that may be performed on the various parts of an aircraft. It is desirable that the configuration information maintained by an airline or other aircraft operator is changed as needed to reflect any changes in the aircraft configuration that may result from performing maintenance operations on the parts of the aircraft.

It may be desirable that an airline or other operator of an aircraft maintains parts information related to the maintenance of the parts of the aircraft. For example, it may be desirable that the parts information includes information identifying various characteristics of the parts of the aircraft that may be useful for maintaining the various parts of the aircraft. It also may be desirable that such parts information is available for use by maintenance personnel and others when needed or desired for performing maintenance operations on the parts of the aircraft or for other purposes.

It may be desirable that parts information for the parts of an aircraft includes maintenance history information identifying maintenance operations that have been performed on the parts. Such maintenance history information may be useful for maintaining the aircraft parts and other purposes. For example, without limitation, maintenance personnel may use such maintenance history information to determine whether a maintenance operation has already been performed on an aircraft part, the nature and extent of any maintenance operations that may have already been performed on the part, when further maintenance of a part is required or desired, what further maintenance may be required or desired to be performed on an aircraft part, or for any other appropriate purpose or combination of purposes related to maintaining an aircraft part. Maintenance history information for the parts on an aircraft also may provide a record of compliance with required or desired aircraft maintenance schedules. In any case, it is desirable that the maintenance history information for the parts of an aircraft is updated accurately and in a timely manner after maintenance operations are performed on the parts.

Automated identification technology tags may be used to automatically identify objects, collect data about the objects, and enter that data directly into a computer system with little or no human involvement. Examples of automated identification technology tags may include radio frequency identification (RFID) tags and contact memory buttons. Automated identification technology tags may be attached to various objects. Information identifying the objects and various characteristics of the objects may be stored in the tags. This information may be read from the tags and automatically entered into a computer system for processing using an appropriate reader device. Such automated identification technology has not been fully utilized for the maintenance of aircraft.

Accordingly, it would be beneficial to have a method and apparatus that take into account one or more of the issues discussed above as well as possibly other issues.

SUMMARY

Illustrative embodiments of the present disclosure provide a method of maintaining a vehicle. Identification information for a part on the vehicle is read from an automated identification technology tag, wherein the automated identification technology tag is on the vehicle and associated with the part. Part information for the part is retrieved from an onboard data processing system on the vehicle using the identification information for the part. The part information retrieved from the onboard data processing system may be displayed to a user.

Illustrative embodiments of the present disclosure also provide an apparatus comprising a user interface on a vehicle, a storage device on the vehicle, and a processor unit on the vehicle. The processor unit on the vehicle is configured to receive identification information for a part on the vehicle from the user interface, retrieve part information for the part from the storage device in response to receiving the identification information for the part, and send the part information retrieved from the storage device to the user interface for display to a user.

Illustrative embodiments of the present disclosure also provide a method of maintaining an aircraft. Configuration information for the aircraft is stored in a storage device in an aircraft network data processing system on the aircraft. The configuration information comprises part information for a part on the aircraft. The part information is retrieved from the storage device by the aircraft network data processing system in response to receiving identification information for the part. The part information is sent by the aircraft network data processing system to a user interface for display to a user. Maintenance information for the part is received by the aircraft network data processing system. The maintenance information identifies a maintenance operation performed on the part. The part information in the storage device is changed by the aircraft network data processing system in response to receiving the maintenance information to form updated configuration information including the maintenance information. The updated configuration information is sent to an off-board data processing system that is not on the aircraft by the aircraft network data processing system.

The features, functions, and benefits may be achieved independently in various embodiments of the present disclosure or may be combined in yet other embodiments in which further details may be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and features thereof will best be understood by reference to the following detailed description of illustrative embodiments of the present disclosure when read in conjunction with the accompanying drawings, wherein:

FIG. 6 is an illustration of a flowchart of another process for maintaining a vehicle in accordance with an illustrative embodiment.

DETAILED DESCRIPTION

Figure 1:
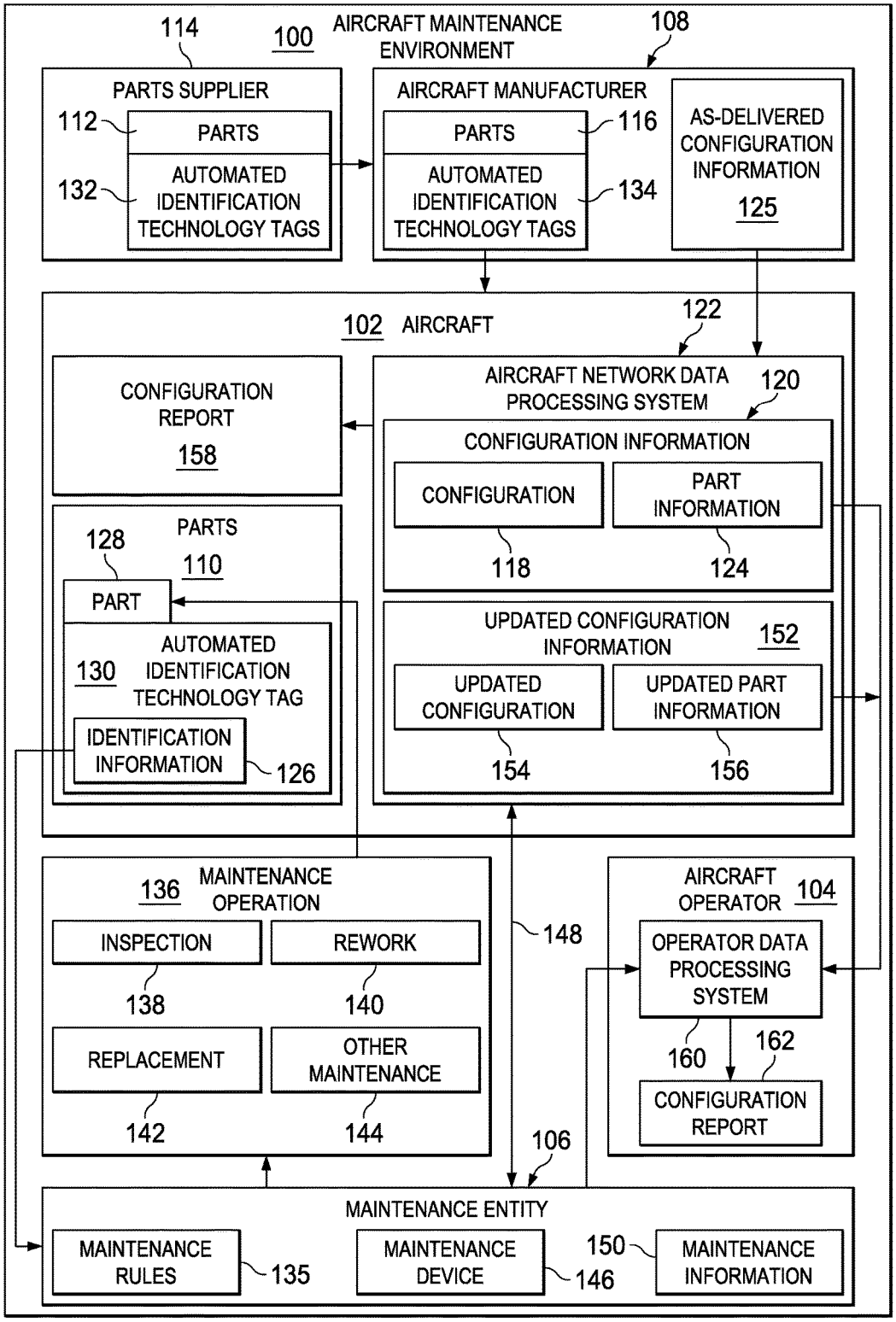
FIG. 1 is an illustration of a block diagram of an aircraft maintenance environment in accordance with an illustrative embodiment.

The different illustrative embodiments recognize and take into account a number of different considerations. "A number," as used herein with reference to items, means one or more items. For example, "a number of different considerations" means one or more different considerations.

The different illustrative embodiments recognize and take into account that it is desirable to maintain accurate configuration information that identifies the parts of an aircraft or other vehicle and various characteristics of those parts. The different illustrative embodiments recognize and take into account that currently, such configuration information may be maintained on paper. Configuration information that is maintained on paper may be relatively difficult and time consuming to keep up-to-date. For example, without limitation, configuration information that is maintained on paper may be relatively difficult and time consuming to change in response to changes in the parts of the vehicle, to identify maintenance operations performed on the parts, and for other purposes. Furthermore, configuration information that is maintained on paper may be relatively difficult to use and make available for use by maintenance personnel and others. For example, it may be relatively difficult and expensive to make paper copies of the latest configuration information readily available to those who may need or desire to use the information to perform maintenance operations on a vehicle or for other purposes.

The different illustrative embodiments recognize and take into account that configuration information identifying the parts of an aircraft or other vehicle and various characteristics of those parts may be maintained by an operator of the aircraft or other vehicle on an off-board data processing system that is not on the vehicle. For example, without limitation, an airline may maintain such configuration information for an aircraft on an off-board data processing system that is operated by or for the airline at a ground location that is not on the aircraft. The different illustrative embodiments recognize and take into account that access to the configuration information stored in such an off-board data processing system may not always be available when needed or desired. For example, without limitation, it may be desirable to perform maintenance operations on an aircraft or other vehicle at a remote location or under conditions for which an acceptable connection for communications with an off-board data processing system cannot be established. In this case, it may not be possible for maintenance personnel to retrieve configuration information from the off-board data processing system that may be necessary or useful for performing the maintenance operations. Furthermore, in this case, updating the configuration information to include maintenance history information identifying the maintenance operations that were performed may be delayed until an acceptable connection for communications with the off-board data processing system can be established.

The different illustrative embodiments recognize and take into account that part information, including maintenance history information for a part, may be stored on an automated identification technology tag that is attached to the part or otherwise attached to an aircraft or other vehicle and associated with the part on the aircraft or other vehicle. In this case, the part information may be available for use in performing maintenance operations on the aircraft or other vehicle even when acceptable communications between the aircraft or other vehicle and off-board systems cannot be established. The different illustrative embodiments also recognize and take into account, however, that reading information from an automated identification technology tag may require the use of an appropriate reader device. Therefore, maintenance personnel or others may not be able to access the part information stored on an automated identification technology tag on an aircraft or other vehicle if an appropriate reader device is not available.

The different illustrative embodiments also recognize and take into account that writing information to an automated identification technology tag may be relatively more difficult than reading information from an automated identification technology tag. For example, without limitation, maintenance personnel may be able to read part information from an automated identification technology tag for a part on an aircraft or other vehicle for use in performing a maintenance operation on the part. However, the maintenance personnel may experience difficulty in updating the part information stored on the automated identification technology tag to include maintenance information identifying the maintenance operation performed on the part. Moreover, the operator of an aircraft or other vehicle on which automated identification technology tags are used to store part information for the parts of the aircraft or other vehicle may need to implement appropriate access control methods to ensure that only authorized users are able to write information to the automated identification technology tags on the aircraft or other vehicle.

The different illustrative embodiments also recognize and take into account that the amount of maintenance history information for a part that may be desirable to store on an automated identification technology tag may be unpredictable and may be voluminous in some cases. Therefore, it may be desirable to use automated identification technology tags that are configured to receive and store a relatively large amount of information to store the part information for a part on an aircraft or other vehicle. In this case, it is less likely that there will not be enough storage capacity on an automated identification technology tag associated with a part to store desirable maintenance history information and other information for the part. However, the different illustrative embodiments recognize and take into account that automated identification technology tags that are configured to receive and store more information may be more expensive than automated identification technology tags that are configured to store less information thereon. Therefore, the use of automated identification technology tags that are configured to receive and store a relatively large amount of information thereon for storing part information on a vehicle may significantly increase the cost of a vehicle, such as an aircraft, that has a relatively large number of parts.

The different illustrative embodiments also recognize and take into account that it may be desirable that changes to part information that are stored in automated identification technology tags on an aircraft or other vehicle are reflected in configuration information for the aircraft or other vehicle that is maintained off-board the aircraft or other vehicle. For example, without limitation, an airline may want to ensure that the configuration information for an aircraft that is maintained off-board the aircraft accurately identifies any maintenance operations that may have been performed on the parts of the aircraft. Therefore, the airline may need to develop an appropriate method to synchronize the latest information on all of the automated identification tags for parts of the aircraft with the configuration information for the aircraft that is maintained in an off-board system.

In accordance with an illustrative embodiment, identification information for parts on an aircraft or other vehicle may be stored in automated identification technology tags associated with the parts on the aircraft or other vehicle. More detailed part information for the parts, such as maintenance history information and other information for the parts, may be stored in a data processing system onboard the aircraft or other vehicle. Maintenance personnel or others may read the identification information from an automated identification technology tag for a part using an appropriate maintenance device. The identification information for the part may be used to retrieve the more detailed part information for the part from the onboard data processing system. The more detailed part information may be displayed on the maintenance device and used, for example, to perform a maintenance operation on the part. The maintenance device also may be used to update the part information stored in the onboard data processing system to include, for example, information identifying the maintenance operation performed on the part.

In accordance with an illustrative embodiment, part information that may be necessary or useful for performing maintenance operations on the parts of an aircraft or other vehicle, or for other purposes, may be stored in an onboard data processing system on the aircraft or other vehicle. Such part information may be readily obtained from the onboard data processing system for use on the aircraft or other vehicle. A suitable connection for communication between the aircraft or other vehicle and an off-board system that is not on the aircraft or other vehicle does not need to be established to use the part information stored on the onboard system. Part information stored in the onboard data processing system may be updated, for example, to identify maintenance operations performed on the parts of the aircraft or other vehicle. Therefore, illustrative embodiments may provide complete and up-to-date configuration information for an aircraft or other vehicle on the aircraft or other vehicle. Such up-to-date configuration information may be sent from the onboard data processing system on the aircraft or other vehicle to an off-board data processing system that is not on the aircraft or other vehicle at an appropriate time, when satisfactory communications between the aircraft or other vehicle and the off-board system can be established. Thus, the illustrative embodiments also may provide complete and up-to-date configuration information for an aircraft or other vehicle on an off-board system that is not on the aircraft or other vehicle. For example, without limitation, such an off-board system may be operated by or for an operator of the aircraft or other vehicle.

In accordance with an illustrative embodiment, part information may be retrieved from an onboard data processing system on an aircraft or other vehicle and viewed using an appropriate maintenance device that is configured to read identification information from an automated identification technology tag associated with the part on the aircraft or other vehicle. In this case, the identification information read from the automated identification technology tag for the part may be used to identify the part information for the part in the onboard data processing system that is retrieved and displayed on the maintenance device. The maintenance device also may be used to update the part information for the part that is stored in the onboard data processing system. For example, without limitation, the maintenance device may be used to update the part information stored in the onboard data processing system to include maintenance information identifying a maintenance operation performed on the part. Alternatively, part information may be retrieved from the onboard data processing system, displayed to a user, and updated by a user via a user interface to the onboard data processing system other than the maintenance device. In this case, part information stored on an aircraft or other vehicle may be used and updated when a maintenance device configured to read information from automated identification technology tags associated with the parts on the aircraft or other vehicle is not available.

In accordance with an illustrative embodiment, only identification information for identifying parts of an aircraft or other vehicle may be stored in automated identification technology tags associated with the parts on the aircraft or other vehicle. Such identification information may be locked in the automated identification technology tags such that the identification information stored in the automated identification technology tags cannot be changed by maintenance personnel or others on the aircraft or other vehicle. More detailed and voluminous part information for the parts may be stored in the onboard data processing system on the aircraft or other vehicle. For example, the part information stored in the onboard data processing system may include maintenance history information identifying maintenance operations performed on the parts. Because a relatively small amount of identity information may be stored on the automated identification technology tags and the information that is stored on the automated identification technology tags need not be changed on the aircraft or other vehicle, relatively inexpensive automated identification technology tags may be used. Furthermore, difficulties associated with writing information to automated identification technology tags and the need to provide access controls to prevent unauthorized writing to automated identification technology tags on the aircraft or other vehicle may be avoided.

Turning now to FIG. 1, an illustration of a block diagram of an aircraft maintenance environment is depicted in accordance with an illustrative embodiment. In this illustrative example, aircraft maintenance environment 100 comprises aircraft 102. For example, without limitation, aircraft 102 may include any type of commercial, military, or other aircraft.

Aircraft 102 in aircraft maintenance environment 100 may be operated by aircraft operator 104. For example, without limitation, aircraft operator 104 may be an airline, military or other government entity, or any other operator of aircraft 102.

Aircraft 102 may be maintained in aircraft maintenance environment 100 by maintenance entity 106. Maintenance entity 106 may be any entity for maintaining aircraft 102. For example, without limitation, maintenance entity 106 may be aircraft operator 104 or an entity employed by aircraft operator 104 to maintain aircraft 102. For example, without limitation, maintenance entity 106 may include aircraft manufacturer 108.

Aircraft 102 may comprise parts 110. Parts 110 also may be referred to as components of aircraft 102. Aircraft manufacturer 108 may assemble parts 110 to form aircraft 102. For example, without limitation, parts 110 of aircraft 102 may include parts 112 provided by parts supplier 114. Parts 112 may be provided from parts supplier 114 to aircraft manufacturer 108. Aircraft manufacturer 108 may provide parts 116 for aircraft 102. Aircraft manufacturer 108 may combine parts 112 from parts supplier 114 along with parts 116 provided by aircraft manufacturer 108 to form parts 110 of aircraft 102. Parts 110 of aircraft 102 also may include parts 110 from other sources. For example, without limitation, parts 110 of aircraft 102 may include parts 110 provided by aircraft operator 104, from another appropriate source, or from various combinations of sources.

Parts 110 forming aircraft 102 define configuration 118 of aircraft 102. It may be desirable that configuration 118 of aircraft 102 is known. For example, without limitation, government regulations may require aircraft operator 104 to keep appropriate records identifying configuration 118 of aircraft 102. It may be desirable for maintenance entity 106 to know configuration 118 of aircraft 102 to maintain aircraft 102 in an effective and efficient manner.

In accordance with an illustrative embodiment, configuration 118 of aircraft 102 may be identified by configuration information 120 stored onboard aircraft 102. For example, without limitation, configuration information 120 may be stored in aircraft network data processing system 122 or in another appropriate system or device on aircraft 102. Aircraft network data processing system 122 also may be referred to as an onboard network system on aircraft 102. For example, without limitation, configuration information 120 may be stored in an appropriate storage device that is part of or connected to aircraft network data processing system 122.

Configuration information 120 may include part information 124. Part information 124 may include any appropriate information regarding parts 110 of aircraft 102 that comprise configuration 118 of aircraft 102. Part information 124 may include information identifying various characteristics of parts 110 of aircraft 102. Part information 124 may be used for various purposes on aircraft 102. For example, without limitation, part information 124 may be used by maintenance entity 106 to perform maintenance on parts 110 of aircraft 102.

As-delivered configuration information 125 may identify configuration 118 of aircraft 102 at the time that aircraft 102 is delivered from aircraft manufacturer 108 to aircraft operator 104. For example, without limitation, as-delivered configuration information 125 may include part information 124 for parts 110 of aircraft 102 as delivered from aircraft manufacturer 108 to aircraft operator 104. As-delivered configuration information 125 may comprise the initial configuration information 120 stored onboard aircraft 102. For example, without limitation, as-delivered configuration information 125 may be stored in aircraft network data processing system 122 or elsewhere on aircraft 102 by aircraft manufacturer 108 before aircraft 102 is delivered by aircraft manufacturer 108 to aircraft operator 104. Alternatively, as-delivered configuration information 125 may be delivered to aircraft 102 and stored in aircraft network data processing system 122 or elsewhere on aircraft 102 in any appropriate manner and by any appropriate entity after aircraft 102 is delivered by aircraft manufacturer 108 to aircraft operator 104.

In accordance with an illustrative embodiment, identification information 126 for part 128 on aircraft 102 may be stored on automated identification technology tag 130 associated with part 128 on aircraft 102. Part 128 may be one of parts 110 of aircraft 102. Automated identification technology tag 130 may be, for example, a radio frequency identification tag, a contact memory, a bar code, or any other appropriate automated identification technology tag. Automated identification technology tag 130 may be attached to part 128 or otherwise associated with part 128 on aircraft 102. For example, without limitation, automated identification technology tag 130 may be associated with part 128 on aircraft 102 by being attached to aircraft 102 at a location near part 128 on aircraft 102.

Identification information 126 for part 128 may be stored on automated identification technology tag 130 on aircraft 102 in any appropriate manner. For example, without limitation, automated identification technology tags 132 may be attached to parts 112 by parts supplier 114. In this case, identification information for parts 112 may be stored on automated identification technology tags 132 by parts supplier 114 before parts 112 are delivered to aircraft manufacturer 108. Alternatively, or in addition, aircraft manufacturer 108 may store identification information for parts 112 from parts supplier 114 on automated identification technology tags 132 attached to parts 112 by parts supplier 114. As another example, automated identification technology tags 134 may be attached by aircraft manufacturer 108 to parts 112 provided by parts supplier 114, parts 116 provided by aircraft manufacturer 108, or both. In this case, aircraft manufacturer 108 may store identification information for parts 112 and 116 on automated identification technology tags 132 and 134, respectively.

As a further example, automated identification technology tag 130 may be attached to part 128 on aircraft 102 or to a location on aircraft 102 near part 128 on aircraft 102 by aircraft manufacturer 108, maintenance entity 106, or any other appropriate entity. In this case, identification information 126 for part 128 may be stored on automated identification technology tag 130 by aircraft manufacturer 108, maintenance entity 106, or any other appropriate entity. In any case, identification information 126 stored on automated identification technology tag 130 may be locked or otherwise fixed in any appropriate manner such that the ability to change identification information 126 stored on automated identification technology tag 130 on aircraft 102 is reduced or eliminated.

Identification information 126 on automated identification technology tag 130 may include any appropriate information for identifying part 128 on aircraft 102. Preferably, identification information 126 stored on automated identification technology tag 130 may comprise a relatively small or minimal amount of information for identifying part 128. For example, without limitation, identification information 126 may comprise a part number for part 128, a serial number for part 128, or any other appropriate information or combination of information for identifying part 128 on aircraft 102. In accordance with an illustrative embodiment, identification information 126 for part 128 on automated identification technology tag 130 may be used to identify and retrieve part information 124 for part 128 that is stored in aircraft network data processing system 122 on aircraft 102.

Maintenance entity 106 may maintain aircraft 102 in accordance with appropriate maintenance rules 135. For example, maintenance rules 135 may define various procedures for inspecting and maintaining aircraft 102. Maintenance rules 135 may define part of a maintenance program for maintaining aircraft 102 in an airworthy condition. Maintenance rules 135 may define various rules for determining whether aircraft 102 is airworthy. Maintenance rules 135 may be developed and provided to maintenance entity 106 from various sources. For example, maintenance rules 135 may include manufacturer instructions for maintaining aircraft 102 that are provided by aircraft manufacturer 108. For example, without limitation, manufacturer instructions may include instructions for continued airworthiness. These instructions may specify procedures for inspection, maintenance, repair, and replacement of various parts 110 of aircraft 102. Maintenance rules 135 also may include operator rules provided by aircraft operator 104 for the inspection and maintenance of aircraft 102. Maintenance rules 135 may be developed by aircraft manufacturer 108, aircraft operator 104, another entity, or a combination of entities to satisfy regulations issued by a government agency or other entity with authority to issue regulations regarding the maintenance of aircraft 102.

In accordance with an illustrative embodiment, maintenance entity 106 may use part information 124 stored in aircraft network data processing system 122 on aircraft 102 to maintain aircraft 102. For example, maintenance entity 106 may use part information 124 for part 128 stored in aircraft network data processing system 122 on aircraft 102 to perform maintenance operation 136 on part 128. For example, without limitation, part information 124 for part 128 may include information that may be used by maintenance entity 106 to identify when maintenance operation 136 should be performed on part 128, what maintenance operation 136 should be performed on part 128, maintenance operation 136 already performed on part 128, other information, or various combinations of information that may be necessary or useful for performing maintenance operation 136 on part 128.

For example, without limitation, maintenance operation 136 may include inspection 138 of part 128, rework 140 of part 128, replacement 142 of part 128, other maintenance 144 of part 128, or any appropriate combination of maintenance operations that may be performed on part 128. For example, maintenance entity 106 may perform inspection 138 of part 128 to identify any inconsistencies in part 128 that may affect aircraft 102 in an undesired manner. Maintenance entity 106 may rework 140 part 128 to remove any identified inconsistencies. Alternatively, replacement 142 of part 128 with inconsistencies may be performed by maintenance entity 106. Whether rework 140 or replacement 142 of part 128 with inconsistencies is appropriate in a particular situation may be defined by maintenance rules 135.

In accordance with an illustrative embodiment, maintenance entity 106 may use maintenance device 146 to read identification information 126 for part 128 from automated identification technology tag 130 associated with part 128. For example, without limitation, maintenance device 146 may be a portable device that is configured to read identification information 126 from automated identification technology tag 130. Identification information 126 read from automated identification technology tag 130 may be sent from maintenance device 146 to aircraft network data processing system 122 on aircraft 102. For example, without limitation, identification information 126 may be sent to aircraft network data processing system 122 from maintenance device 146 automatically in response to reading identification information 126 from automated identification technology tag 130 by maintenance device 146. Alternatively, or in addition, a user may initiate the communication of identification information 126 from maintenance device 146 to aircraft network data processing system 122.

Identification information 126 may be sent from maintenance device 146 to aircraft network data processing system 122 via communications link 148. Communications link 148 may comprise any appropriate wired or wireless method for exchanging information between maintenance device 146 and aircraft network data processing system 122 on aircraft 102. For example, without limitation, communications link 148 may be implemented using a secure Wi-Fi connection or other appropriate wireless or wired connection between maintenance device 146 and aircraft network data processing system 122.

Aircraft network data processing system 122 may be configured to use identification information 126 received from maintenance device 146 to identify part information 124 stored onboard aircraft 102 for part 128 of aircraft 102 identified by identification information 126. Part information 124 identified as corresponding to identification information 126 received from maintenance device 146 may be sent back to maintenance device 146. For example, without limitation, part information 124 for part 128 may be identified and sent back to maintenance device 146 via communications link 148 automatically by aircraft network data processing system 122 in response to receiving identification information 126 from maintenance device 146.

Part information 124 received by maintenance device 146 from aircraft network data processing system 122 on aircraft 102 may be used by maintenance entity 106 to perform maintenance operation 136 on part 128. For example, part information 124 for part 128 received from aircraft network data processing system 122 may be displayed on maintenance device 146 for use by maintenance entity 106 to perform maintenance operation 136 on part 128.

Maintenance entity 106 may use maintenance device 146 to send maintenance information 150 to aircraft network data processing system 122 on aircraft 102. For example, maintenance device 146 may be configured to receive maintenance information 150 from maintenance entity 106. Maintenance information 150 received from maintenance entity 106 then may be sent from maintenance device 146 to aircraft network data processing system 122 via communications link 148.

Maintenance information 150 comprises information identifying maintenance operation 136 performed on part 128. Maintenance operation 136 may change configuration 118 of aircraft 102. In this case, maintenance information 150 sent to aircraft network data processing system 122 may be used to change configuration information 120 so that configuration information 120 stored onboard aircraft 102 accurately identifies configuration 118 of aircraft 102 after maintenance operation 136 is performed. Maintenance information 150 received by aircraft network data processing system 122 may be used to update part information 124 stored onboard aircraft 102 for part 128. For example, maintenance information 150 for part 128 received by aircraft network data processing system 122 may be used to update maintenance history information in part information 124 for part 128.

Changing configuration information 120 in aircraft network data processing system 122 on aircraft 102 to include maintenance information 150 identifying maintenance operation 136 performed on part 128 forms updated configuration information 152. Updated configuration information 152 identifies updated configuration 154 of aircraft 102. Updated configuration 154 includes changes to configuration 118 of aircraft 102 resulting from maintenance operation 136 performed on part 128. Changing configuration information 120 in aircraft network data processing system 122 to include maintenance information 150 may include changing part information 124 to include maintenance information 150. Changing part information 124 to include maintenance information 150 identifying maintenance operation 136 performed on part 128 forms updated part information 156. Updated configuration 154 becomes configuration 118 of aircraft 102, updated configuration information 152 becomes configuration information 120, and updated part information 156 becomes part information 124 for part 128 until configuration 118 of aircraft 102 is updated again by the performance of another maintenance operation 136 or in another appropriate manner.

Configuration information 120 stored onboard aircraft 102 may be used to generate configuration report 158 on aircraft 102. Configuration report 158 may present configuration information 120 in any appropriate manner to identify configuration 118 of aircraft 102 onboard aircraft 102. Because configuration information 120 onboard aircraft 102 may be updated promptly to reflect maintenance operation 136 performed on aircraft 102, configuration report 158 provided on aircraft 102 will accurately identify configuration 118 of aircraft 102. Configuration report 158 may be generated and displayed in any appropriate manner on aircraft 102. For example, without limitation, configuration report 158 may be generated by aircraft network data processing system 122 and sent to maintenance device 146 for display on aircraft 102.

Configuration information 120 stored on aircraft 102 may be sent to an appropriate location off-board aircraft 102 for analysis, display, or any other appropriate purpose. For example, without limitation, configuration information 120 may be sent from aircraft 102 to operator data processing system 160 located off-board aircraft 102. Operator data processing system 160 may be any appropriate data processing system that is operated by or for aircraft operator 104 at a location on the ground or at any other appropriate location that is not on aircraft 102. Configuration information 120 may be provided from aircraft network data processing system 122 on aircraft 102 to operator data processing system 160 via any appropriate network or other communications link.

Configuration information 120 may be sent from aircraft 102 to operator data processing system 160 periodically whenever an appropriate communications link from aircraft 102 to operator data processing system 160 may be established. For example, to ensure that the latest configuration information 120 is available on operator data processing system 160, updated configuration information 152 may be sent from aircraft 102 to operator data processing system 160 whenever configuration information 120 is updated to include maintenance information 150 identifying maintenance operation 136 performed on aircraft 102, if an appropriate communications link can be established between aircraft 102 and operator data processing system 160 at that time. If an appropriate communications link cannot be established at that time, updated configuration information 152 may be sent from aircraft network data processing system 122 to operator data processing system 160 off-board aircraft 102 when an appropriate communications link between aircraft 102 and operator data processing system 160 can be established.

Configuration information 120 from aircraft 102 that is stored in operator data processing system 160 may be used for any appropriate purpose. For example, without limitation, configuration information 120 stored in operator data processing system 160 may be used to generate configuration report 162 off-board aircraft 102. Configuration report 162 may present configuration information 120 in any appropriate manner to identify configuration 118 of aircraft 102 off-board aircraft 102.

The illustration of FIG. 1 is not meant to imply physical or architectural limitations to the manner in which different illustrative embodiments may be implemented. Other components in addition to, in place of, or both in addition to and in place of the ones illustrated may be used. Some components may be unnecessary in some illustrative embodiments. Also, the blocks are presented to illustrate some functional components. One or more of these blocks may be combined or divided into different blocks when implemented in different illustrative embodiments.

For example, aircraft network data processing system 122 may be configured to allow a user to access and change part information 124 stored on aircraft 102 without using maintenance device 146 or another device to read identification information 126 for part 128 from automated identification technology tag 130 associated with part 128 on aircraft 102. For example, without limitation, a user interface for aircraft network data processing system 122 may be configured to allow a user to manually identify part 128 for which part information 124 stored on aircraft 102 may be retrieved or otherwise to search for part information 124 for part 128 that is stored in aircraft network data processing system 122 on aircraft 102. The user interface for aircraft network data processing system 122 may be configured to display part information 124 for identified part 128 to the user in an appropriate manner for use, for example, in performing maintenance operation 136 on part 128. The user interface for aircraft network data processing system 122 also may be configured to receive from the user maintenance information 150 identifying maintenance operation 136 performed on part 128 to update part information 124 stored onboard aircraft 102. The user interface for aircraft network data processing system 122 also may be configured to display configuration report 158 that is generated by aircraft network data processing system 122 using configuration information 120 stored on aircraft 102.

Figure 2:
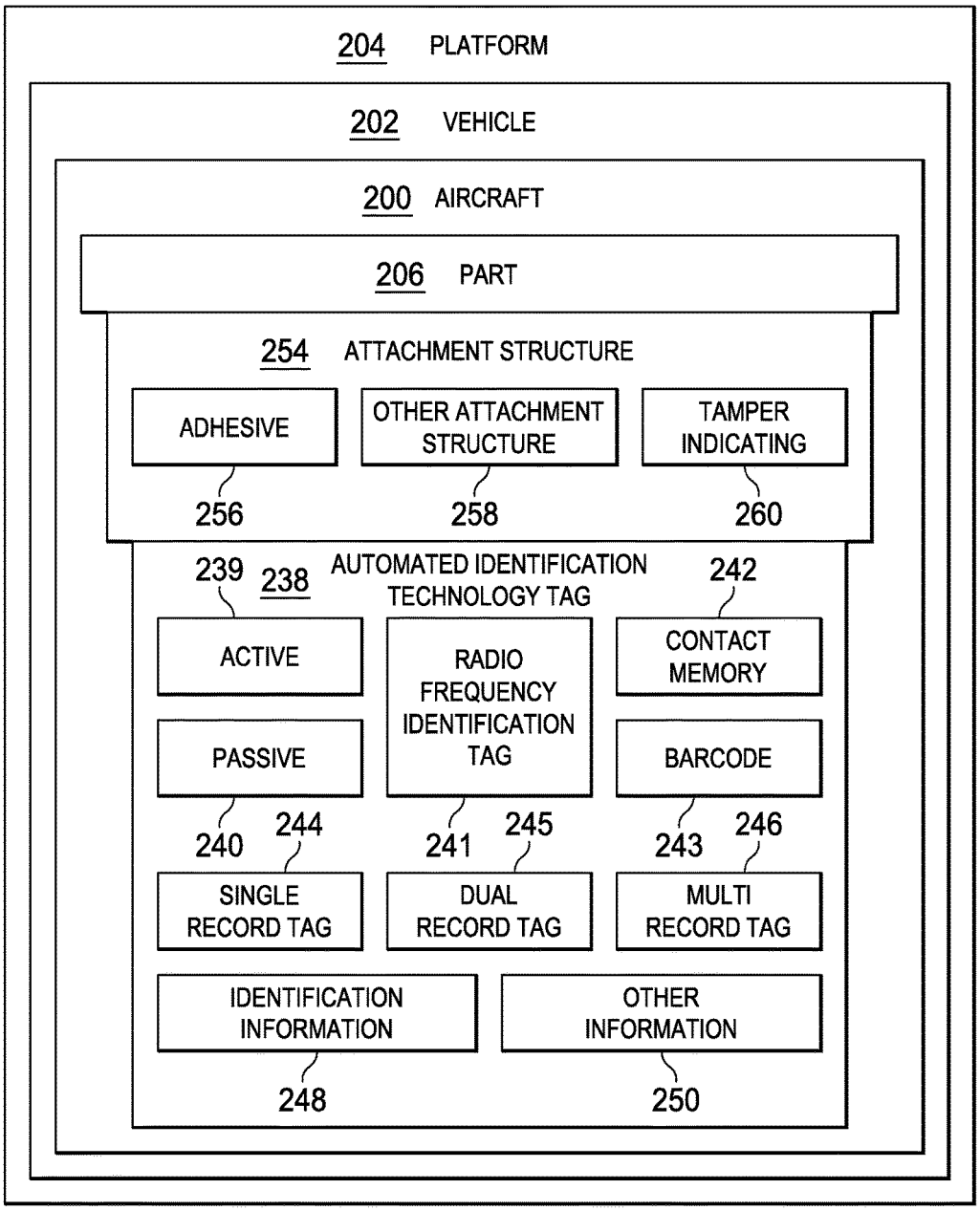
FIG. 2 is an illustration of a block diagram of an aircraft in accordance with an illustrative embodiment.

Turning now to FIG. 2, an illustration of a block diagram of an aircraft is depicted in accordance with an illustrative embodiment. Aircraft 200 may be an example of one implementation of aircraft 102 in FIG. 1.

Aircraft 200 is an example of vehicle 202. Illustrative embodiments may be used for the maintenance of vehicle 202 other than aircraft 200. Vehicle 202 may be any vehicle configured for operation in the air, in space, on land, on water, under water, or in any other medium or combinations of media.

Vehicle 202 is an example of platform 204. Illustrative embodiments may be used for the maintenance of platform 204 other than vehicle 202. For example, platform 204 may be any fixed or mobile structure.

Aircraft 200 may include part 206. Part 206 may include a number of various components of aircraft 200. Part 206 may be located at any appropriate location on aircraft 200.

Automated identification technology tag 238 may be associated with part 206 on aircraft 200. Automated identification technology tag 238 may be active 239 or passive 240. Active 239 automated identification technology tag 238 may be powered by an internal battery. Passive 240 automated identification technology tag 238 may operate without its own power source. For example, passive 240 automated identification technology tag 238 may obtain power from a reader when interrogated by the reader to read information from automated identification technology tag 238 or to write information to automated identification technology tag 238.

Automated identification technology tag 238 may include radio frequency identification tag 241, contact memory 242, barcode 243, or another appropriate type of automated identification technology tag. Radio frequency identification tag 241 uses radio frequency electromagnetic fields to transfer information when interrogated by a reader. The information stored in radio frequency identification tag 241 may be read from up to several yards away. Radio frequency identification tag 241 does not need to be within the line of sight of a reader to be interrogated. Therefore, for example, without limitation, radio frequency identification tag 241 may be imbedded in part 206 or in a structure of aircraft 200 near the location of part 206 on aircraft 200.

Contact memory 242 also may be referred to as touch memory. Contact memory 242 is an electronic identification device that may be packaged in a button-shaped container. Information in contact memory 242 is accessed when a touch probe for a reader is brought into contact with contact memory 242.

Barcode 243 is an optical machine-readable representation of information relating to part 206. For example, barcode 243 may represent information relating to part 206 by varying widths and spacings of parallel lines. Alternatively, barcode 243 may represent information relating to part 206 using a two-dimensional pattern of rectangles, dots, hexagons, or other appropriate patterns or combinations of patterns.

Automated identification technology tag 238 may comprise single record tag 244, dual record tag 245, or multi record tag 246. Single record tag 244 may be configured to store a relatively small amount of information thereon. For example, single record tag 244 may be configured to store less than approximately 2 kilobytes or another appropriate amount of information thereon. Furthermore, information stored on single record tag 244 may be locked so that the information stored on single record tag 244 may not be changed by writing to single record tag 244 when single record tag 244 is associated with part 206 on aircraft 200 or other vehicle 202.

Dual record tag 245 also may be configured to store a relatively small amount of information thereon. For example, dual record tag 245 may be configured to store less than approximately 8 kilobytes or another appropriate amount of information thereon. Some of the information stored on dual record tag 245 may be locked. Other information stored on dual record tag 245 may be changed by writing to dual record tag 245 using an appropriate reader device when dual record tag 245 is associated with part 206 on aircraft 200 or other vehicle 202. Dual record tag 245 may be relatively more expensive than single record tag 244.

Multi record tag 246 may be configured to store a relatively large amount of information thereon. For example, multi record tag 246 may be configured to store more than approximately 8 kilobytes or another appropriate amount of information thereon. Some of the information stored on multi record tag 246 may be locked. However, most of the storage space on multi record tag 246 may be changed by writing to multi record tag 246 using an appropriate reader device when multi record tag 246 is associated with part 206 on aircraft 200 or other vehicle 202. Multi record tag 246 may be relatively more expensive than single record tag 244 and dual record tag 245.

In accordance with an illustrative embodiment, identification information 248 for part 206 may be stored on automated identification technology tag 238. Identification information 248 may include any appropriate information identifying part 206 associated with automated identification technology tag 238. Identification information 248 may comprise a relatively small amount of information. For example, without limitation, identification information 248 may be locked in automated identification technology tag 238 so that identification information 248 stored on automated identification technology tag 238 may not be changed by writing to automated identification technology tag 238 when automated identification technology tag 238 is associated with part 206 on aircraft 200 or other vehicle 202.

Other information 250 also may be stored on automated identification technology tag 238 associated with part 206. Other information 250 stored on automated identification technology tag 238 may include information describing various characteristics of part 206. For example, without limitation, other information 250 stored on automated identification technology tag 238 may include information identifying maintenance operations performed on part 206. Preferably, however, such maintenance history information for part 206 may be stored in a data processing system onboard aircraft 200 or other vehicle 202 so that such other information 250 need not be written to automated identification technology tag 238 when automated identification technology tag 238 is associated with part 206 on aircraft 200 or other vehicle 202. Because a relatively small amount of identification information 248 may be stored on automated identification technology tag 238 and other information 250 need not be written to automated identification technology tag 238 when automated identification technology tag 238 is associated with part 206 on aircraft 200 or other vehicle 202, automated identification technology tag 238 preferably may be implemented using less expensive single record tag 244 or dual record tag 245.

Automated identification technology tag 238 may be attached to part 206 or to another structure on aircraft 200 or other vehicle 202 located near part 206 by attachment structure 254. Attachment structure 254 may include any appropriate structure for attaching automated identification technology tag 238 to part 206 or to another structure on aircraft 200 or other vehicle 202. For example, attachment structure 254 may include adhesive 256, other attachment structure 258, or a combination of structures for attaching automated identification technology tag 238 to part 206 or to another structure on aircraft 200 or other vehicle 202. Attachment structure 254 may be tamper indicating 260. For example, without limitation, radio frequency identification tag 241 may be provided with tear-off provisions built in the tag so that when the tag is disturbed or damaged, the tag is disabled and rendered inoperative by the separation of the microchip from the antenna and packaging in radio frequency identification tag 241.

Figure 3:
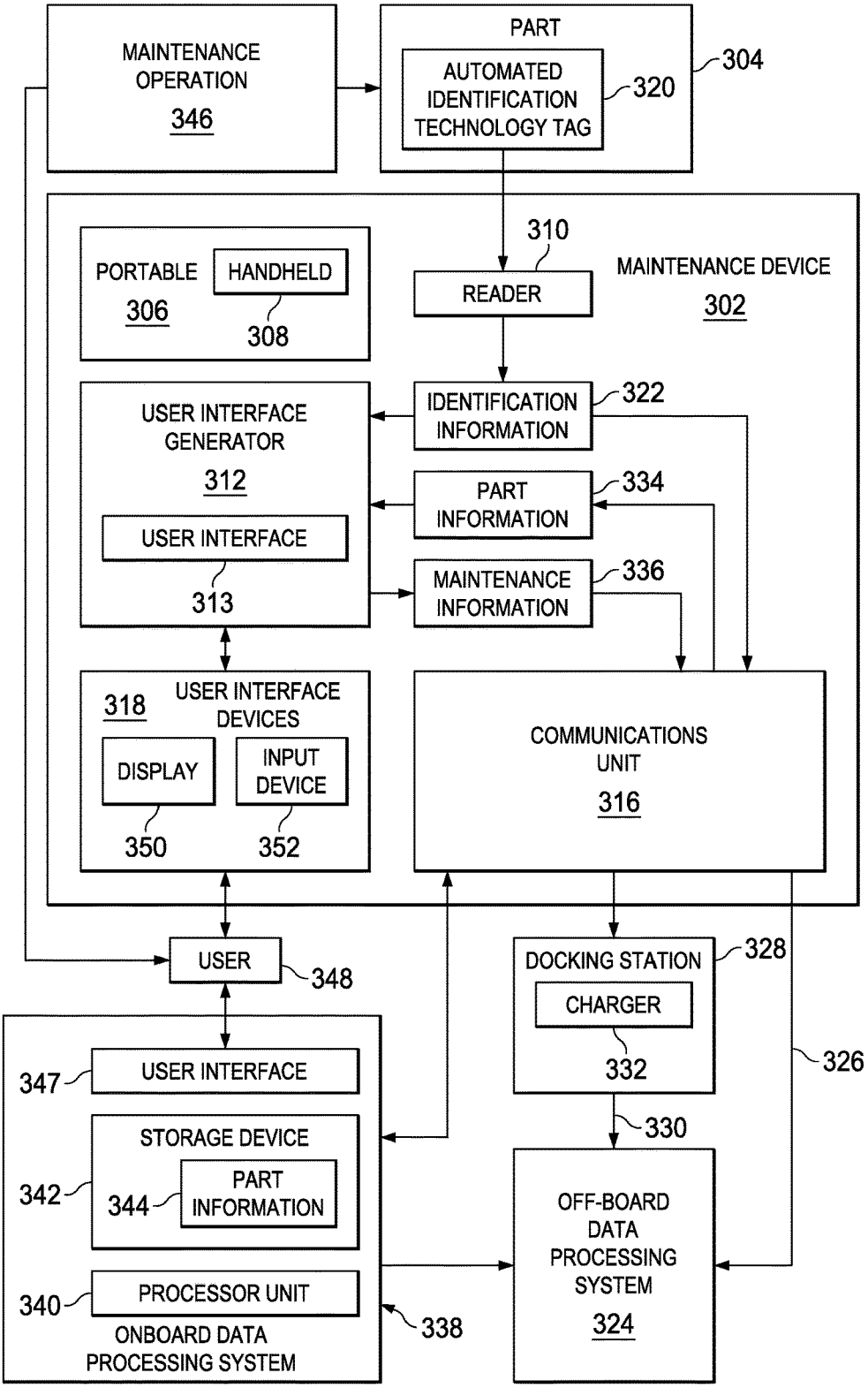
FIG. 3 is an illustration of a block diagram of a maintenance device in accordance with an illustrative embodiment.

Turning now to FIG. 3, an illustration of a block diagram of a maintenance device is depicted in accordance with an illustrative embodiment. Maintenance device 302 may be an example of one implementation of maintenance device 146 in FIG. 1. Maintenance device 302 may be configured to be used for maintaining part 304. Part 304 may be an example of part 206 on aircraft 200 or other vehicle 202 in FIG. 2.

Maintenance device 302 may be portable 306. For example, without limitation, maintenance device 302 may be handheld 308. Maintenance device 302 may include reader 310, user interface generator 312, communications unit 316, and user interface devices 318.

Automated identification technology tag 320 may be associated with part 304. Identification information 322 for part 304 may be stored on automated identification technology tag 320. Reader 310 may be configured to read identification information 322 from automated identification technology tag 320. Reader 310 also may be configured to write information to automated identification technology tag 320.

Identification information 322 may be provided from reader 310 to user interface generator 312. User interface generator 312 may be configured to generate user interface 313 for displaying identification information 322 to user 348 on user interface devices 318. User interface generator 312 also may be configured to generate user interface 313 for displaying part information 334 to user 348 on user interface devices 318. User interface generator 312 also may be configured to generate user interface 313 configured for receiving maintenance information 336 from user 348. User interface devices 318 may include display 350 for displaying information to user 348 and input device 352 for receiving input from user 348.

Identification information 322 also may be provided from reader 310 to communications unit 316 for communication to onboard data processing system 338. Onboard data processing system 338 may include processor unit 340 and storage device 342. Part information 344 for part 304 may be stored in storage device 342. Processor unit 340 may be configured to receive identification information 322 from maintenance device 302 and to use identification information 322 to identify and retrieve part information 344 for part 304 from storage device 342. Part information 344 from onboard data processing system 338 may be sent back to maintenance device via communications unit 316. Part information 344 received by communications unit 316 may be provided as part information 334 to user interface generator 312 for display to user 348 on user interface devices 318. For example, without limitation, user 348 may use part information 334 to perform maintenance operation 346 on part 304.

User 348 may enter maintenance information 336 into maintenance device 302 via user interface 313 and user interface devices 318. Maintenance information 336 may identify maintenance operation 346 performed on part 304. Maintenance information 336 may be sent to onboard data processing system 338 via communications unit 316. Processor unit 340 may be configured to change part information 344 in storage device 342 to include maintenance information 336 for part 304.

Alternatively, user 348 may obtain part information 344 for part 304 from onboard data processing system 338 via user interface 347 of onboard data processing system 338. User 348 also may provide maintenance information 336 to onboard data processing system 338 via user interface 347. Thus, part information 344 for part 304 may be retrieved for use by user 348 and updated to identify maintenance operation 346 performed on part 304 when maintenance device 302 is unavailable.

Maintenance device 302 also may be configured to send maintenance information 336 to off-board data processing system 324 via communications unit 316. For example, without limitation, off-board data processing system 324 may be a data processing system operated by or for an operator of an aircraft or other vehicle comprising part 304. Communications unit 316 may be configured to send maintenance information 336 and other information to off-board data processing system 324 at any appropriate time via wireless connection 326. Alternatively, or in addition, communications unit 316 may be configured to send maintenance information 336 and other information to off-board data processing system 324 via docking station 328 when maintenance device 302 is placed in docking station 328. Docking station 328 may be connected to off-board data processing system 324 via connection 330. Connection 330 may be a wired or wireless connection.

Maintenance device 302 may be a battery powered device. In this case, docking station 328 also may be configured to operate as charger 332 for charging a battery in maintenance device 302 when maintenance device 302 is placed in docking station 328.

The illustration of FIG. 3 is not meant to imply physical or architectural limitations to the manner in which different illustrative embodiments may be implemented. Other components in addition to, in place of, or both in addition to and in place of the ones illustrated may be used. Some components may be unnecessary in some illustrative embodiments. Also, the blocks are presented to illustrate some functional components. One or more of these blocks may be combined or divided into different blocks when implemented in different illustrative embodiments.

Figure 4:
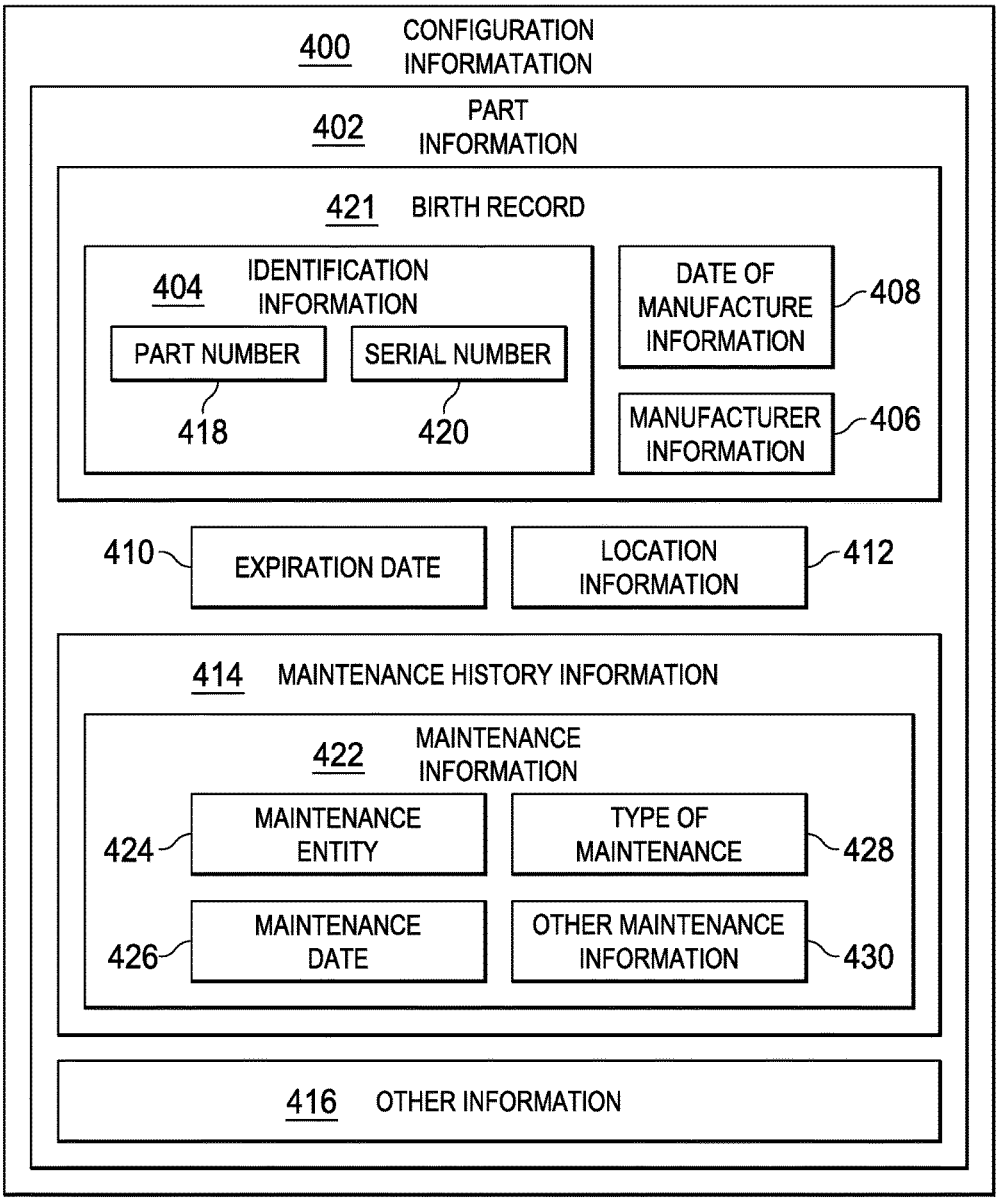
FIG. 4 is an illustration of a block diagram of configuration information in accordance with an illustrative embodiment.

Turning now to FIG. 4, an illustration of a block diagram of configuration information is depicted in accordance with an illustrative embodiment. Configuration information 400 may be an example of configuration information 120 for aircraft 102 in FIG. 1.

For example, without limitation, configuration information 400 may include part information 402 for a part of the configuration described by configuration information 400. Part information 402 may include identification information 404, manufacturer information 406, date of manufacture information 408, expiration date 410, location information 412, maintenance history information 414, and other information 416.

Identification information 404 may include one or more of part number 418 and serial number 420 for a part. Identification information 404, manufacturer information 406, and date of manufacture information 408 may comprise birth record 421 for the part.

Maintenance history information 414 may include maintenance information 422 identifying each time that a maintenance operation is performed on a part. For example, without limitation, maintenance information 422 may identify maintenance entity 424 that performed the maintenance operation, maintenance date 426 when the maintenance operation was performed, type of maintenance 428 that was performed during the maintenance operation, other maintenance information 430, or various combinations of information identifying a maintenance operation performed on a part.

Figure 5:
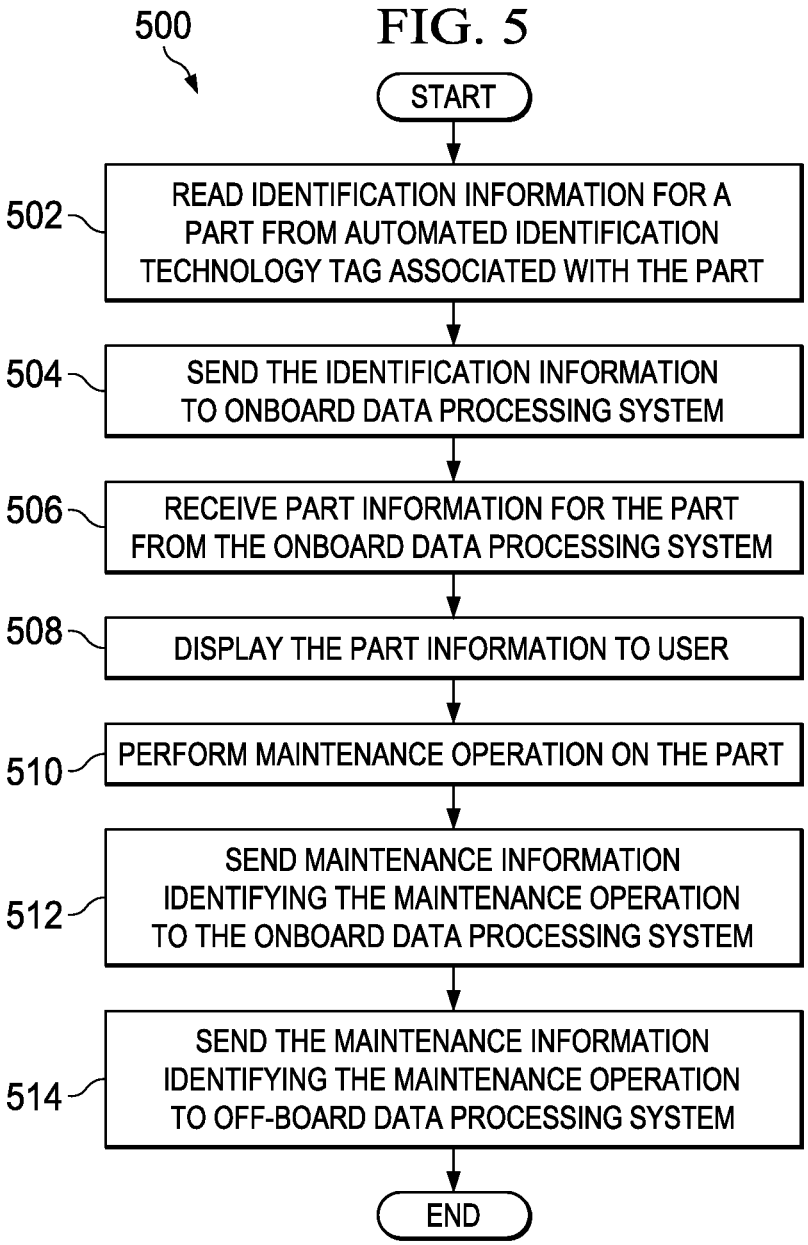
FIG. 5 is an illustration of a flowchart of a process for maintaining a vehicle in accordance with an illustrative embodiment.

Turning now to FIG. 5, an illustration of a flowchart of a process for maintaining a vehicle is depicted in accordance with an illustrative embodiment. Process 500 may be implemented, for example, using maintenance device 146 in FIG. 1 or maintenance device 302 in FIG. 3.

Process 500 may begin by reading identification information for a part from an automated identification technology tag associated with the part (operation 502). The identification information then may be sent to an onboard data processing system that is on the aircraft or other vehicle comprising the part (operation 504). Part information for the part may be received from the onboard data processing system (operation 506). The received part information may be displayed to a user (operation 508). The user may use the displayed part information to perform a maintenance operation on the part (operation 510). Maintenance information identifying the maintenance operation performed may be sent to the onboard data processing system (operation 512). Maintenance information identifying the maintenance operation also may be sent to an off-board data processing system (operation 514), with the process terminating thereafter.

Turning now to FIG. 6, an illustration of a flowchart of another process for maintaining a vehicle is depicted in accordance with an illustrative embodiment. For example, process 600 may be implemented in aircraft network data processing system 122 on aircraft 102 in FIG. 1 or in onboard data processing system 338 in FIG. 3.

Process 600 begins by storing part information in an onboard data processing system (operation 602). It then may be determined whether identification information for a part is received (operation 604). Operation 604 may be repeated until it is determined that identification information for a part is received. When identification information for a part is received, part information for the part is retrieved from the onboard data processing system using the identification information (operation 606). The retrieved part information may be displayed to a user (operation 608).

It then may be determined whether maintenance information identifying a maintenance operation performed on a part is received (operation 610). If maintenance information is not received, the process may terminate. If maintenance information is received, the part information in the onboard data processing system may be changed to include the maintenance information (operation 612). The updated part information then may be sent to an off-board data processing system (operation 614), with the process terminating thereafter.

Figure 7:
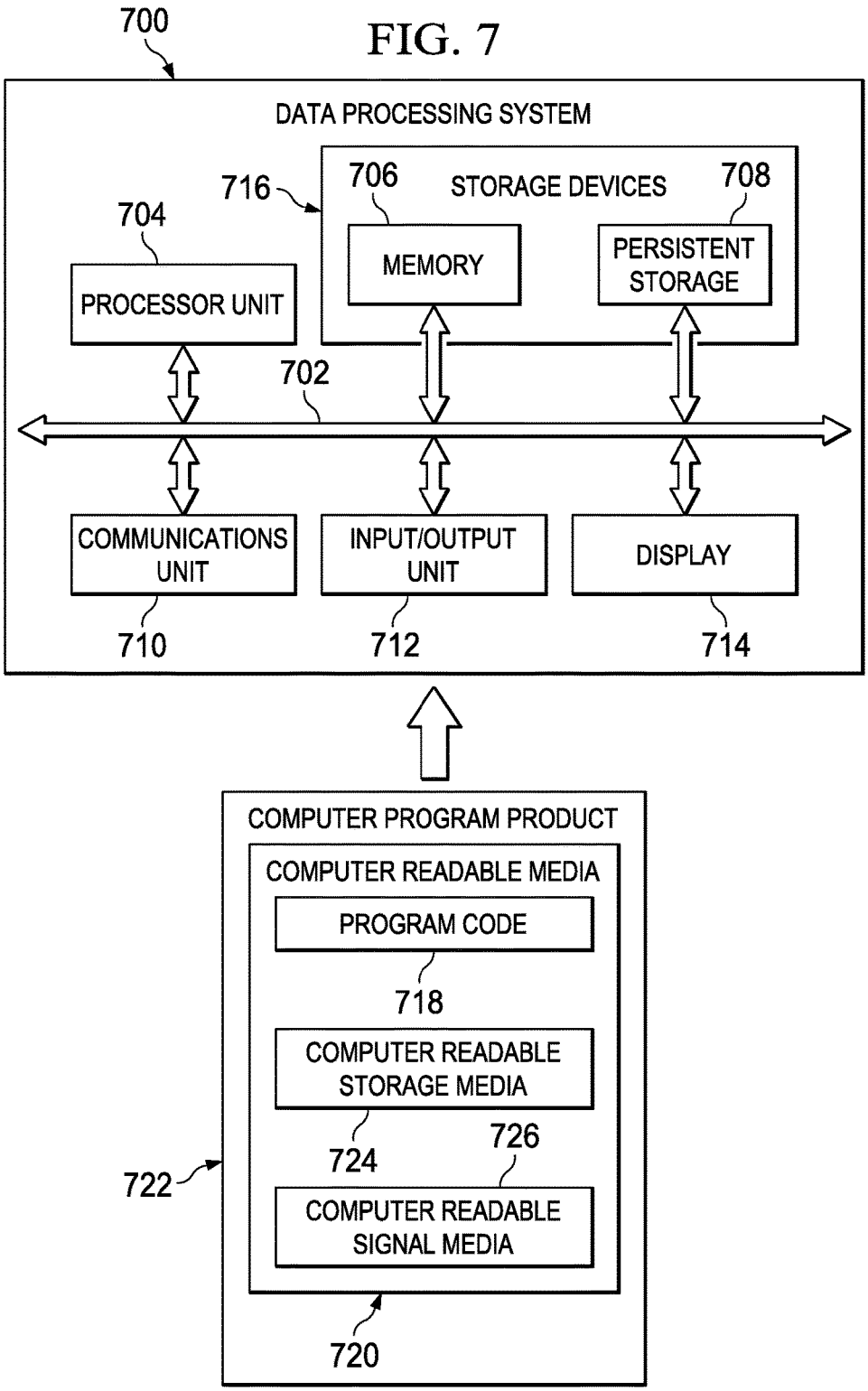
FIG. 7 is an illustration of a block diagram of a data processing system in accordance with an illustrative embodiment.

Turning now to FIG. 7, an illustration of a block diagram of a data processing system is depicted in accordance with an illustrative embodiment. Data processing system 700 may be an example of one implementation of a data processing system for implementing aircraft network data processing system 122 or maintenance device 146 in FIG. 1.

In this illustrative example, data processing system 700 includes communications fabric 702. Communications fabric 702 provides communications between processor unit 704, memory 706, persistent storage 708, communications unit 710, input/output unit 712, and display 714. Memory 706, persistent storage 708, communications unit 710, input/output unit 712, and display 714 are examples of resources accessible by processor unit 704 via communications fabric 702.

Processor unit 704 serves to run instructions for software that may be loaded into memory 706. Processor unit 704 may be a number of processors, a multi-processor core, or some other type of processor, depending on the particular implementation. Further, processor unit 704 may be implemented using a number of heterogeneous processor systems in which a main processor is present with secondary processors on a single chip. As another illustrative example, processor unit 704 may be a symmetric multi-processor system containing multiple processors of the same type.

Memory 706 and persistent storage 708 are examples of storage devices 716. A storage device is any piece of hardware that is capable of storing information, such as, for example, without limitation, data, program code in functional form, and other suitable information either on a temporary basis or a permanent basis. Storage devices 716 also may be referred to as computer readable storage devices in these examples. Memory 706, in these examples, may be, for example, a random access memory or any other suitable volatile or non-volatile storage device. Persistent storage 708 may take various forms, depending on the particular implementation.

For example, persistent storage 708 may contain one or more components or devices. For example, persistent storage 708 may be a hard drive, a flash memory, a rewritable optical disk, a rewritable magnetic tape, or some combination of the above. The media used by persistent storage 708 also may be removable. For example, a removable hard drive may be used for persistent storage 708.

Communications unit 710, in these examples, provides for communications with other data processing systems or devices. In these examples, communications unit 710 is a network interface card. Communications unit 710 may provide communications through the use of either or both physical and wireless communications links.

Input/output unit 712 allows for input and output of data with other devices that may be connected to data processing system 700. For example, input/output unit 712 may provide a connection for user input through a keyboard, a mouse, and/or some other suitable input device. Further, input/output unit 712 may send output to a printer. Display 714 provides a mechanism to display information to a user.

Instructions for the operating system, applications, and/or programs may be located in storage devices 716, which are in communication with processor unit 704 through communications fabric 702. In these illustrative examples, the instructions are in a functional form on persistent storage 708. These instructions may be loaded into memory 706 for execution by processor unit 704. The processes of the different embodiments may be performed by processor unit 704 using computer-implemented instructions, which may be located in a memory, such as memory 706.

These instructions are referred to as program instructions, program code, computer usable program code, or computer readable program code that may be read and executed by a processor in processor unit 704. The program code in the different embodiments may be embodied on different physical or computer readable storage media, such as memory 706 or persistent storage 708.

Program code 718 is located in a functional form on computer readable media 720 that is selectively removable and may be loaded onto or transferred to data processing system 700 for execution by processor unit 704. Program code 718 and computer readable media 720 form computer program product 722 in these examples. In one example, computer readable media 720 may be computer readable storage media 724 or computer readable signal media 726.

Computer readable storage media 724 may include, for example, an optical or magnetic disk that is inserted or placed into a drive or other device that is part of persistent storage 708 for transfer onto a storage device, such as a hard drive, that is part of persistent storage 708. Computer readable storage media 724 also may take the form of a persistent storage, such as a hard drive, a thumb drive, or a flash memory, that is connected to data processing system 700. In some instances, computer readable storage media 724 may not be removable from data processing system 700.

In these examples, computer readable storage media 724 is a physical or tangible storage device used to store program code 718 rather than a medium that propagates or transmits program code 718. Computer readable storage media 724 is also referred to as a computer readable tangible storage device or a computer readable physical storage device. In other words, computer readable storage media 724 is a media that can be touched by a person.

Alternatively, program code 718 may be transferred to data processing system 700 using computer readable signal media 726. Computer readable signal media 726 may be, for example, a propagated data signal containing program code 718. For example, computer readable signal media 726 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 718 may be downloaded over a network to persistent storage 708 from another device or data processing system through computer readable signal media 726 for use within data processing system 700. For instance, program code stored in a computer readable storage medium in a server data processing system may be downloaded over a network from the server to data processing system 700. The data processing system providing program code 718 may be a server computer, a client computer, or some other device capable of storing and transmitting program code 718.

The different components illustrated for data processing system 700 are not meant to provide architectural limitations to the manner in which different embodiments may be implemented. The different illustrative embodiments may be implemented in a data processing system including components in addition to and/or in place of those illustrated for data processing system 700. Other components shown in FIG. 7 can be varied from the illustrative examples shown. The different embodiments may be implemented using any hardware device or system capable of running program code. As one example, data processing system 700 may include organic components integrated with inorganic components and/or may be comprised entirely of organic components excluding a human being. For example, a storage device may be comprised of an organic semiconductor.

In another illustrative example, processor unit 704 may take the form of a hardware unit that has circuits that are manufactured or configured for a particular use. This type of hardware may perform operations without needing program code to be loaded into a memory from a storage device to be configured to perform the operations.

For example, when processor unit 704 takes the form of a hardware unit, processor unit 704 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, a programmable array logic, a field programmable logic array, a field programmable gate array, and other suitable hardware devices. With this type of implementation, program code 718 may be omitted, because the processes for the different embodiments are implemented in a hardware unit.

In still another illustrative example, processor unit 704 may be implemented using a combination of processors found in computers and hardware units. Processor unit 704 may have a number of hardware units and a number of processors that are configured to run program code 718. With this depicted example, some of the processes may be implemented in the number of hardware units, while other processes may be implemented in the number of processors.

In another example, a bus system may be used to implement communications fabric 702 and may be comprised of one or more buses, such as a system bus or an input/output bus. Of course, the bus system may be implemented using any suitable type of architecture that provides for a transfer of data between different components or devices attached to the bus system.

Additionally, communications unit 710 may include a number of devices that transmit data, receive data, or both transmit and receive data. Communications unit 710 may be, for example, a modem or a network adapter, two network adapters, or some combination thereof. Further, a memory may be, for example, memory 706, or a cache, such as that found in an interface and memory controller hub that may be present in communications fabric 702.

The flowcharts and block diagrams described herein illustrate the architecture, functionality, and operation of possible implementations of systems, methods, and computer program products according to various illustrative embodiments. In this regard, each block in the flowcharts or block diagrams may represent a module, segment, or portion of code, which comprises one or more executable instructions for implementing the specified logical function or functions. It should also be noted that, in some alternative implementations, the functions noted in a block may occur out of the order noted in the figures. For example, the functions of two blocks shown in succession may be executed substantially concurrently, or the functions of the blocks may sometimes be executed in the reverse order, depending upon the functionality involved.

The description of the different illustrative embodiments has been presented for purposes of illustration and description and is not intended to be exhaustive or to limit the embodiments in the form disclosed. Many modifications and variations will be apparent to those of ordinary skill in the art. Further, different illustrative embodiments may provide different benefits as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method of maintaining a vehicle, comprising:

reading identification information for a part on the vehicle from an automated identification technology tag by a maintenance device, wherein the automated identification technology tag is on the vehicle and associated with the part;

sending the identification information for the part that is read from the automated identification technology tag from the maintenance device to an onboard data processing system on the vehicle;

receiving the identification information for the part sent from the maintenance device by the onboard data processing system on the vehicle;

using the identification information for the part received from the maintenance device by the onboard data processing system on the vehicle to identify and retrieve part information for the part from a storage device on the vehicle;

sending the part information for the part retrieved from the storage device on the vehicle from the onboard data processing system to the maintenance device;

receiving the part information for the part by the maintenance device from the onboard data processing system on the vehicle, wherein the part information for the part includes maintenance history information for the part;

displaying the part information received from the onboard data processing system to a user on the maintenance device;

using the part information displayed on the maintenance device to perform a maintenance operation on the part; and sending maintenance information identifying the maintenance operation performed on the part to the onboard data processing system.

2. The method of claim 1, wherein the automated identification technology tag is selected from a radio frequency identification tag, a contact memory, and a bar code.

3. The method of claim 1, wherein the automated identification technology tag comprises a single record tag, wherein information stored on the single record tag is locked so that the information stored on the single record tag cannot be changed by writing to the single record tag when the single record tag is on the vehicle and associated with the part.

4. The method of claim 1, wherein the automated identification technology tag is attached to the part.

5. The method of claim 1, wherein:

the identification information for the part is selected from a part number for the part and a serial number for the part.

6. The method of claim 1 further comprising:

changing the part information for the part in the storage device on the vehicle to form updated part information for the part including the maintenance information identifying the maintenance operation performed on the part.

7. The method of claim 6, wherein the maintenance device is portable and is connected to the onboard data processing system via a communications link.

8. The method of claim 1 further comprising:

sending the maintenance information identifying the maintenance operation performed on the part from one of the onboard data processing system and the maintenance device to an off-board data processing system that is not on the vehicle.

9. The method of claim 1, wherein the vehicle is an aircraft and the onboard data processing system is an aircraft network data processing system on the aircraft.

10. An apparatus, comprising:

a maintenance device that is configured to read identification information for a part on a vehicle from an automated identification technology tag and to send the identification information for the part that is read from the automated identification technology tag to an onboard data processing system on the vehicle, wherein the maintenance device comprises a user interface and wherein the automated identification technology tag is on the vehicle and associated with the part;

a storage device on the vehicle; and the onboard data processing system on the vehicle comprising a processor unit on the vehicle, wherein the onboard data processing system on the vehicle is configured to receive the identification information for the part sent from the maintenance device, use the identification information for the part received from the maintenance device to identify and retrieve part information for the part from the storage device on the vehicle, wherein the part information for the part includes maintenance history information for the part stored on the storage device on the vehicle, send the part information for the part retrieved from the storage device on the vehicle to the maintenance device for display on the user interface, receive maintenance information identifying a maintenance operation performed on the part, and store the maintenance information identifying the maintenance operation performed on the part on the storage device on the vehicle.

11. The apparatus of claim 10, wherein the automated identification technology tag is selected from a radio frequency identification tag, a contact memory, and a bar code.

12. The apparatus of claim 10, wherein the automated identification technology tag is a single record tag, wherein information stored on the single record tag is locked so that the information stored on the single record tag cannot be changed by writing to the single record tag when the single record tag is on the vehicle and associated with the part.

13. The apparatus of claim 10, wherein the automated identification technology tag is attached to the part.

14. The apparatus of claim 10, wherein:

the identification information for the part is selected from a part number for the part and a serial number for the part.

15. The apparatus of claim 10, wherein the onboard data processing system on the vehicle is further configured to:

change the part information for the part in the storage device on the vehicle to form updated part information for the part including the maintenance information identifying the maintenance operation performed on the part.

16. The apparatus of claim 15, wherein the onboard data processing system on the vehicle is further configured to send the updated part information for the part to an off-board data processing system that is not on the vehicle.

17. The apparatus of claim 10, wherein the vehicle is an aircraft and the onboard data processing system on the vehicle comprises an aircraft network data processing system on the aircraft.

18. A method of maintaining an aircraft, comprising:

reading identification information for a part on the aircraft from an automated identification technology tag by a maintenance device, wherein the automated identification technology tag is on the aircraft and associated with the part;

sending the identification information for the part that is read from the automated identification technology tag from the maintenance device to an aircraft network data processing system on the aircraft;

receiving the identification information for the part sent from the maintenance device by the aircraft network data processing system on the aircraft;

using the identification information for the part received from the maintenance device by the aircraft network data processing system on the aircraft to identify and retrieve part information for the part from a storage device on the aircraft, wherein the part information for the part includes maintenance history information for the part;

sending the part information for the part retrieved from the storage device on the aircraft by the aircraft network data processing system on the aircraft to the maintenance device for display to a user;

receiving maintenance information for the part by the aircraft network data processing system, wherein the maintenance information identifies a maintenance operation performed on the part;

changing the part information in the storage device by the aircraft network data processing system in response to receiving the maintenance information to form updated configuration information including the maintenance information; and sending the updated configuration information to an off-hoard data processing system that is not on the aircraft by the aircraft network data processing system.

19. The method of claim 18 further comprising:

receiving, by the maintenance device, the part information from the aircraft network data processing system;

displaying the part information received from the aircraft network data processing system on a user interface on the maintenance device;

receiving, by the maintenance device, the maintenance information for the part from the user; and sending the maintenance information for the part from the maintenance device to the aircraft network data processing system.

* * * * *